United States Patent [19]

Brouwer

[11] 4,421,141

[45] Dec. 20, 1983

[54] FABRIC SELVAGE FORMING

[75] Inventor: Charles W. Brouwer, East Greenwich, R.I.

[73] Assignee: Leesona Corporation, Warwick, R.I.

[21] Appl. No.: 64,391

[22] Filed: Aug. 6, 1979

[51] Int. Cl.[3] ..... D03D 47/40

[52] U.S. Cl. ..... 139/54

[58] Field of Search ..... 139/54, 430, 383 R

[56] References Cited

U.S. PATENT DOCUMENTS 3,945,406 3/1976 Wueger ..... 139/54

4,072,174 2/1978 Wagner ..... 139/54

*Primary Examiner*—Henry Jaudon

*Attorney, Agent, or Firm*—Burnett W. Norton

[57] ABSTRACT

Increased resistance to unraveling is imparted to a fringe selvage of the type formed by weaving on a fluid weft insertion loom by means of a special selvage construction produced along the opposite side edges of the fabric which combines a pair of twisted binder threads and a juxtaposed leno chain stitch. The binder threads extending along the edges of the warp are opened or separated for the insertion of each weft thread therebetween and then closed and separated in the opposite direction to entwine around the corresponding end of each inserted weft thread while being simultaneously twisted about their own axis and preferably the timing of the closing of the binder threads during the weaving cycle is slightly in advance of the closing of the warp shed itself. The leno chain stitch is situated immediately interior of the binder threads and is constituted of two separate leno strands which are looped under alternating weft strands on either side of a multiplicity of warp strands at each fabric edge and criss crossed over the intervening weft strands, the criss crossing being achieved by reversing the locations of the leno threads preferably while the warp shed itself is in substantially fully open condition.

16 Claims, 2 Drawing Figures

FABRIC SELVAGE FORMING

FIELD OF THE INVENTION

This invention relates to a loom weaving system in which the weft is inserted through the shed of the loom by means of a pulse-like jet of air or other pressurized gaseous medium (hereinafter referred to generally as a fluid weft insertion system) and is concerned more particularly with an improved technique for creating along at least one edge of the woven fabric a special selvage which locks the weft strands after their insertion into the shed and prevents the ends of the weft strands at the fabric side from pulling free of the warp strands during weaving or thereafter.

BACKGROUND OF THE INVENTION

In recent years, the textile industry has devoted considerable attention to the development of improved fluid weft insertion looms in which the weft strand is delivered through the warp shed by means of a stream of a fluid, such as air or water, emitted from a nozzle situated proximate to the shed, instead of by means of a shuttle projected from one side of the shed to the other and carrying a bobbin from which the weft strand is unwound as the shuttle moves through the shed. Such fluid weft insertion looms offer important advantages over shuttle looms in reducing the number of mechanical parts in the loom as well as the energy required for their operation and the noise produced thereby and making possible substantial increases in production speed. However, these advantages are accompanied by certain disadvantages, among which is the formation of a much inferior selvage construction.

In contrast to conventional weaving where a continuous weft thread is pulled back and forth through the shed by the shuttle, so that the ends of the weft are looped around the outside warp threads along the side edges of the fabric and anchored by sinuous engagement with the adjacent warp threads, giving a reasonably dense, tight, secure selvage construction, the weft strands in looms equipped with fluid insertion systems are nearly always projected from the same side of the fabric and each inserted length of weft is severed from the supply before the next weft strand is inserted. Consequently, the ends of the inserted weft extend loosely outside the confines of the warp, producing a so-called "fringe selvage".

In the absence of special measures, a "fringe selvage" tends inherently to be seriously susceptible to unraveling during further handling and processing. The warp threads are, of course, under more or less tension in the woven fabric due to the presence of the weft threads which forces them to assume a sinuous path. However, where the ends of the weft strand are loose at the extreme edges of the fabric and are thus free to bend away from the plane of the fabric, they offer little or no resistance to the inclination of the curved warp threads at those edges to straighten. Once a warp thread at the fabric edge has become straight, it remains so since there is no tension on the weft ends sufficient to overcome the straightening force of the warp and the fabric at this point becomes more open, allowing the looseness of the weft end to work inwardly to the next warp thread where the process is repeated.

While several techniques have been devised to prevent this problem in the past, as will be described more in detail later, all have proved to be less than satisfactory for various reasons, mainly a significant increase in the amount of yarns lost as waste.

DISCOVERY OF THE INVENTION

In accordance with the invention, a special selvage construction which exhibits high integrity and effectively binds and locks the free weft ends into the sides of the fabric is achieved by means of a combination of a pair of twisted binder threads and a juxtaposed leno chain stitch. During weaving the binder threads are separated or opened in one direction perpendicular to the fabric plane for insertion of the weft brought together or closed in that plane, and separated or opened in the opposite direction (similar in principle to the movement of the warp strands during weaving) while being continuously twisted about their axis or length. Thus, the binder thrads are wound over and under the exterior end of each inserted weft while the weft is adjacent the fell of the fabric during beat up but before the weft is sheared at one or both of its ends. Preferably, the weaving cycle is such that the binder threads are closed just slightly in advance of the closing of the warp shed. The leno stitch is created by at least two leno threads criss crossed over and across a terminal plurality of warp strands immediately adjacent the binder threads and looped under alternating weft strands, the location of the leno threads being alternately reversed to criss cross above the plural warp threads substantially when the shed is fully open.

OBJECTS OF THE INVENTION

The object of the invention is the creation of an improved fabric selvage utilizing a combination of a leno selvage weave with an adjacent pair of twisted binder threads which maintains the integrity of the selvage.

Another object of the invention is the creation of the improved fabric selvage as described wherein the binder threads are crossed to grip the free end of the inserted weft before the weft end is sheared and preferably before the warp threads cross to close the shed.

BRIEF DESCRIPTION OF DRAWINGS

These and other objects and advantages will be more fully explained by the following complete description when read in conjunction with the accompanying drawings in which.

GENERAL DESCRIPTION OF FLUID WEFT INSERTION LOOM

Figure 1:
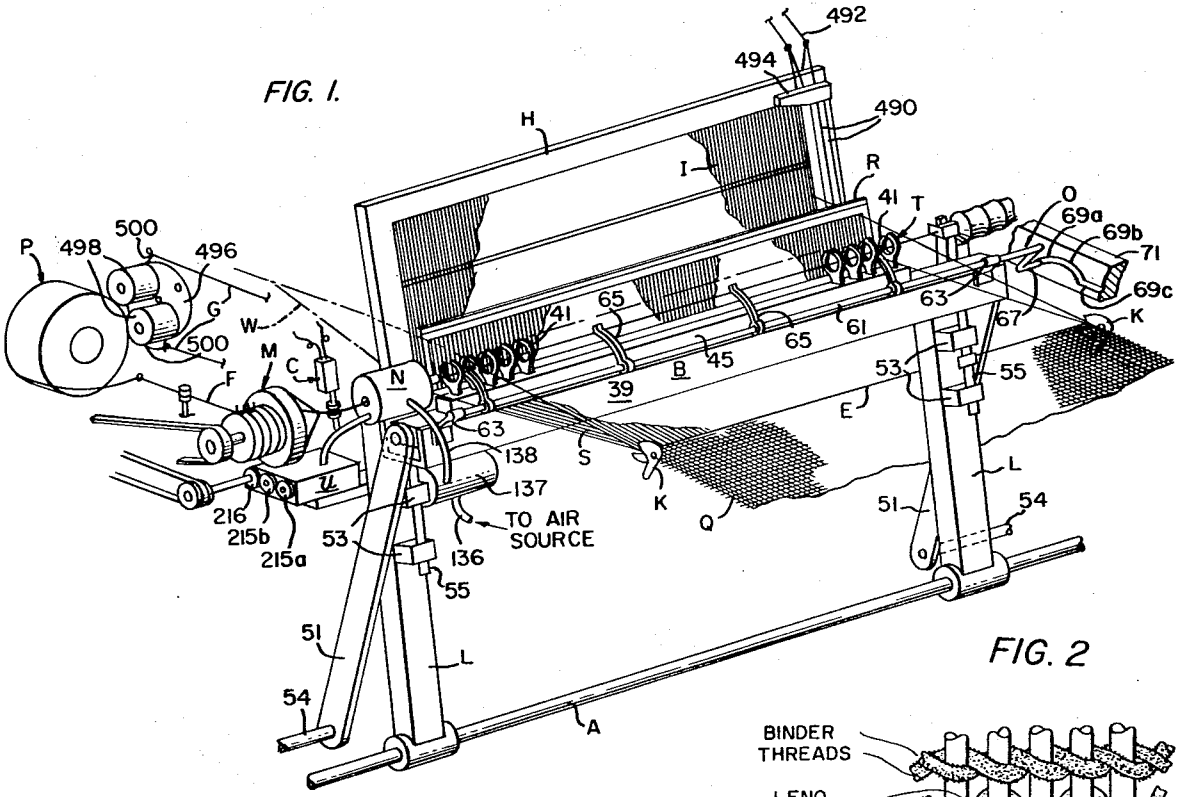
FIG. 1 is a highly schematic view in perspective of the essential components of a loom incorporating the present invention.

The present improvement can be employed with any known fluid weft insertion system but preferably is utilized with the overall system of this type which is described in U.S. application Ser. No. 64,180, filed Aug. 6, 1979, which issued on Sept. 7, 1982 as U.S. Pat. No. 4,347,872 and reference may be had to the complete disclosure found there for an understanding of the details of the various improvements which form part of this preferred system. For present purposes, the loom is illustrated and described only in such general terms as needed to define the context for the invention. As usual, the warp threads or ends W are carried on a rotatably supported warp beam (not seen) and pass therefrom through the eyes of parallel arrays of heddle wires I held by corresponding heddle frames H. The heddle frames H reciprocate up and down and separate or open the warp threads to form an elongated diamond-shaped shed S having its front corner defined by the fell E of the fabric being woven. A lay beam B extends widthwise across the warp supported on generally upstanding supports or swords L pivoted on a shaft A and are rocked to and fro by driving means, such as a crankshaft, not shown. A reed R projects upwardly from the rear side of the lay to impress each new weft against the fell of the fabric as the lay rocks forwardly. The woven fabric is collected in a conventional way upon a take-up beam, not shown.

The fabric has a fringe selvage Q which may be trimmed by means of trimming shears or knives K mounted on the loom frame (not shown) in operative position at the fell line and actuated in the usual way.

The lay B of the loom is equipped with an interrupted segmental weft guidance tube T to facilitate the delivery of weft or filling strands F through the shed, the guidance tube obtruding in interdigitating fashion with the warp ends into the interior of the shed when the lay is in its rearmost position and withdrawing from the shed while the lay moves forward. The lay preferably carries a weft lift-out device generally designated O to positively displace the inserted weft F from the guidance tube independently of the timings of the withdrawal of the latter from the shed during beat-up. The weft is projected into the interrupted guidance tube by means of a burst or pulse of air emitted by a weft insertion nozzle N, while the free end of the inserted weft is received beyond the far side of the shed within a vacuum reception tube V. The flow of air through the nozzle, preferably in the form of a pulse or burst of predetermined duration, is controlled by a nozzle activation control unit U which is actuated in timed relation to the cyclical operation of the loom. A proper length of weft is withdrawn from a weft package or other source P and made available to the insertion nozzle N by means of a strand metering and delivering unit M, and a clamping means C positively grips the weft F in timed relation to the inserting action.

DETAILED DESCRIPTION OF THE INVENTION

The fabric produced by the fluid weft insertion loom invention must, like any other fabric, be capable of undergoing further processing, such as washing, dyeing, printing, tentering and the like, and in particular of being gripped along its edges and stretched taut without undergoing substantial unraveling. However, as noted in the introductory explanation, the selvage formed on fabric woven by a fluid weft insertion loom differs markedly from the selvage of fabric woven on a shuttle loom, in that in a fluid weft insertion loom, each weft is inserted always from the same side of the shed and, after separation from the weft supply is disposed in the fabric as a discrete individual length of thread, having its free ends dangling loose beyond the limits of the warp. Obviously, since these loose weft ends can move freely in all directions, they cannot withstand the tension inherent in the sinuously-bent warp ends; therefore, the outermost warp thread tends to slip free of the weft ends and begin to separate from the fabric which releases the next warp thread to unravel and so on. This problem is particularly acute on the reception side of the fabric because, in contrast to the supply side where the weft end is under tension due to its continuity until after its beat-up against the fell, with the weft supply and the engagement of the intervening length of the latter by the delivery clamp, the opposite weft end on the reception side of the warp has only light tension imposed thereon by the vacuum reception tube which is not adequate to hold the warp threads in place.

Several techniques have been employed in the art to produce a fabric selvage having the necessary integrity for further handling and manipulation. In one case, tuckers have been utilized to engage each exteriorly projecting weft end and to tuck the same bodily between a number of warp threads when the shed is next opened so as to form the free weft ends artificailly into anchored loops securing the outermost warp threads in place. In another case, a group of two or more warp threads are secured by means of a leno chain stitch and an additional group of some 20–30 warp threads is provided outside of the locus of the leno stitch to produce a so-called false selvage. The weft is long enough to weave with this additional group of warp threads, and the result is a marginal strip which can be gripped during handling. The weft ends are loose on the outside of the false selvage which makes unraveling possible, but this is inconsequential since the false selvage strip is eventually severed from the remainder of the fabric and discarded after it has served its purpose.

In either case, the result is the loss of a significant amount of wasted thread. On the one hand, the tucking in of the projecting weft ends produces dense margins along the fabric edge which are readily distinguishable from the body of the fabric and must be severed and discarded before the fabric is used; while on the other, it is the false selvage strip itself that constitutes waste.

Figure 2:
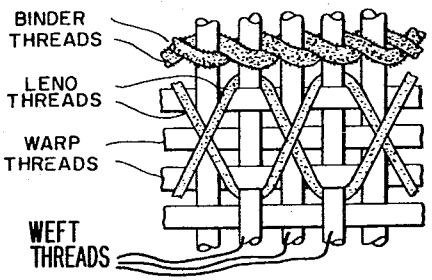
FIG. 2 is an enlarged detail plan view of a fragment of the selvage of the fabric produced by the invention, revealing the combination of twisted binder strands with a leno selvage weave.

In accordance with the invention, the amount of waste at the selvage is reduced to a minimum by an improved selvage forming technique shown in FIG. 2. In this technique, a leno chain stitch is first formed in association with the outside three or four warp threads, which are indicated by stippling in FIG. 2, on at least the edge of the warp opposite the weft insertion nozzle, and for this purpose a conventional leno attachment of a commercially available type is mounted on the front heddle of the loom as indicated diagrammatically in FIG. 1 of the drawings. As is well known in the art, a leno attachment takes the form of the two needle-like members 490 arranged adjacent one corner of the front heddle H generally parallel to the plane of the heddle, each needle having at its lower end an eye through which a leno thread, indicated by shading in FIG. 2, passes from a package (not shown) supported on the rear of the loom frame via one of the guides 492 mounted on the heddle. The two leno needles are mechanically coupled by operating means enclosed within a housing 494 (and not seen) in such a way as to undergo 180° bodily displacement in their relative positions each time the front heddle moves to its raised position and hence oscillate in and out relative to the outermost three or four warp ends, thereby criss-crossing the leno threads over those warp ends. When the front heddle is in its upper position, the leno threads generally follow the angle of the upper side of the shed forwardly of the heddle and thus lie above the path of the next weft. When the front heddle is in lowered position, the leno threads generally follow the lower side of the shed and then pass beneath the next weft. In this way a kind of criss-crossing chain stitch is formed around an outermost group of three or four of the regular warp ends to bind them to the body of the fabric, as indicated by the shaded leno threads in FIG. 2.

In operation, and assuming, for instance, the use of two heddle frames in the loom, both leno threads will loop beneath every other weft thread and then criss-cross, i.e., switch their relative positions, over the top of each intervening alternating weft thread. If the number of heddle frames exceeds three or more, then the leno threads may criss-cross over the top of one weft and loop beneath the remaining two or more wefts before repeating.

The resultant leno chain stitch alone is not sufficient to bind effectively the outermost warp threads to the body of the fabric. The loose weft ends being, as already explained, completely free to move about without restraint, the bight of each leno thread winding beneath a just-inserted weft will immediately pull free as soon as it is tensioned during the next oscillation of the leno needles, destroying the chain stitch effect.

To avoid this problem according to the invention, there is associated with the leno stitch, a rotary binder stitch. To create the rotary binder stitch, a carrier plate 496 for two binder threads G (cross-hatched for identification in FIG. 2) is mounted on the reception side of the shed, and duplicated on the delivery side as well if desired, at a location on the loom frame on the warp beam side, i.e., back side, of the heddles with the plane of the plate 496 arranged vertically and its axis of rotation extending generally parallel to the axis A of the lay. On the outboard face of this plate is a pair of binder thread supply spools 498 and threads G from these supply spools are threaded through flexible strand tension wires 500 projecting at diametrically opposite points from the periphery of the plate. An adjustable friction device (not shown) engages each spool to tension the strand withdrawn therefrom. The flexible tension wires 500 extend radially from the plate periphery to define between the guide eyes at their respective ends a separation roughly equal to the stroke of reciprocation of the heddles H and the binder threads G extend from the terminal guide eyes to the fell F of the fabric.

Carrier plate 496 rotates continuously at a rate synchronized with the rate of operation of the loom so that the plate turns 180° with each loom cycle and 5°–10° in advance of or out of phase with that cycle. Thus, the binder threads G move alternately up and down similar to the shed forming movement of the warp threads but slightly out of phase therewith, while being also simultaneously twisted about one another at the rate of one-half turn of twist per loom operating cycle. This twisting effect is in principle the same as if the carrier plate axis were generally parallel to the thread direction instead of perpendicular thereto, the only difference being that the rotation of the plate displaces the binder supply packages 498 bodily towards and away from the fabric fell E which would introduce slack in the binder threads G were it not for the flexible carrier guide wires 500. These tension wires 500 are designed with sufficient flexibility to maintain the binder threads G under tension during the rotation of carrier plate 496 so that the binder threads G remain taut at all times throughout their length up to the fell of the fabric. The slightly advanced timing of the carrier plate rotation results in the binder threads crossing and entwining a freshly inserted weft as early as possible; and hence, the free end of each weft is immediately upon its insertion pinched between the binder threads. In this way, each free weft end is caught in the grip of the twisted together binder threads G and held in place until the leno chain stitch can be completed around that weft end.

It has been found that the combination of the leno chain stitch and the twisted binder stitch imparts a high degree of integrity to the fabric selvage and enables the same to readily withstand whatever stresses need to be imposed thereon during conventional fabric finishing operations. While the projecting ends of the weft are still necessarily loose or free as a fringe, this does not result in the collapse or unraveling of the binder stitch because the twisted nature of that stitch acts to pinch the free weft end between the opposed binder threads and hold it in place until the weaving has progressed to the point that a sufficient number of new weft ends have been added as to pack all of the threads with sufficient tightness or density as to hold them in place after release of weaving tension. For some purposes, the binder stitch alone may exert adequate restraint upon the weft ends so that the leno chain stitch can be dispensed with, but it is preferred to employ the combination of these two stitches to achieve optimum results. In either case, it is unnecessary to remove any portion of the margins of the fabric, as is required with a false selvage or with a tucked selvage, since the density of the fabric embodying the selvage of the invention remains uniform virtually to its exteme edges and waste is, therefore, reduced to a minimum.

What is claimed is:

1. In a method of weaving in which weft strands are inserted in sequence across an open shed defined by plural vertically separated groups of warp strands, each such inserted weft strand having free ends projecting beyond both side edges of the shed, at least some of said groups of warps being reversed in vertical position after each such insertion to close said shed and re-open it in said reversed position and thereby entwine the warp strands sinuously around the sequentially inserted weft strands to form a fabric, each thus inserted weft strand is beat up against the fell of the fabric being formed in timed relation to the reversal of said groups of warp strands, and the projecting ends of each inserted weft strand are severed adjacent the side edges of the shed before the next weft strand is inserted, the improvement of forming a selvage along each side of said fabric by the steps comprising: guiding a pair of binder strands to the fell of said fabric along each side of said shed, vertically separating said binder strands for the delivery of weft strand therebetween, vertically crossing while mutually twisting together the strands of each said pair of binder strands prior to closing of said shed and severing said projecting weft strand ends to thereby grip said weft strand ends by said binder strands before said weft strand ends are severed, and forming a leno chain stitch by criss-crossing at least two leno threads beneath periodic weft strands and across a terminal plurality of said warp strands along each side of said fabric, said leno threads being criss-crossed above said plural warp strands while said shed is substantially open, said crossed and twisted binder strands being disposed outwardly of said leno chain stitch at the corresponding side of said warp shed.

2. A method as set forth in claim 1 wherein said pair of binder strands are mutually twisted together about their length at the rate of at least one-half turn per loom cycle to frictionally engage each free end of said weft strand therebetween.

3. A method as set forth in claim 2 wherein said pair of binder strands are mutually twisted together continuously at said rate while vertically separating and crossing the same.

4. A method as set forth in claim 1 wherein said leno chain stitch is formed by guiding a pair of leno threads above and below said weft strands in a predetermined sequence in paths which extend generally in the warp direction and are spaced apart in the weft direction, and periodically interchanging the leno threads in said paths.

5. A method as set forth in claim 1 wherein said binder strands are mutually twisted together one-half turn per weaving cycle to cause the same to cross vertically after each cycle, and said crossing is so timed in relation to said vertical reversal of said groups of warp strands that the binder strands cross one another somewhat in advance of the closing of the shed.

6. A method as set forth in claim 1 wherein each said weft end has a leading free end which is inserted across said shed and protrudes beyond said one side of said fabric, and said binder strands operate to bind said free end.

7. A method as set forth in claim 6 wherein each said free end is held in retaining means after passage beyond said one shed side, and said free end is first bound by said binder strands and then severed upstream from said retaining means.

8. In a loom including means for inserting weft strands in sequence across a shed defined by plural vertically separated groups of warp strands, each such inserted strand having free ends projecting beyond both sides of the shed, means for alternately reversing the vertical position of at least some of said groups after each such insertion to close said shed and re-open it in said reversed position to thereby entwine the warp strands sinuously around the sequentially inserted weft strands to form a fabric, means for beating up each inserted weft strand against the fell of the fabric being formed in timed relation to the reversal of said group of warp strands, and means operative for severing the projecting ends of each inserted strand adjacent said shed sides, the improvement comprising: means for guiding a pair of binder strands to the fell of said fabric along each side of said shed, means for vertically separating the binder strands of each said pair for the delivery therebetween of the weft strand and then crossing while mutually twisting said binder strands together to thereby bind said weft strand by said binder strands, and means for forming a leno chain stitch engaging a terminal plurality of warp strands along each shed side inwardly of said binder strands by criss-crossing at least two leno threads below periodic weft strands and across said plural warp strands and means for operating said binder strand separating and crossing means in timed relation to said warp group reversing means and said severing means to cross said binder threads before said warp shed closes and said severing means is operated.

9. Apparatus as set forth in claim 8 including carrier means for supporting supply packages for said binder strands in spaced apart relation and means for rotating said carrier means to simultaneously alternately separate said strands and twist the same together.

10. Apparatus as set forth in claim 8 including means for guiding a pair of leno threads above and below said weft strands in a predetermined sequence in timed relation to the insertion of the latter, said leno threads being guided along paths which extend generally in the warp direction and are spaced apart in the weft direction, and means for periodically interchanging the positions of said guide means to reverse the paths of said leno threads.

11. Apparatus as set forth in claim 8 wherein said means for separating said strands is operable to twist said pair of binder strands together about their length at the rate of at least one-half turn each cycle to frictionally engage said weft strand between said binder strands.

12. Apparatus as set forth in claim 8 including means for tensioning said binder strands being guided to said fell.

13. Apparatus as set forth in claim 8 including retaining means for holding the end of weft yarn protruding between said binder strands.

14. Apparatus as set forth in claim 13 wherein said severing means are operative while said weft end is held in said retaining means.

15. The loom of claim 8 wherein said binder threads separating means is also operated in timed relation to the reversal of the groups of warp strand to cross said binder threads at least 5° of the loom cycle before the warp strand groups are crossed to close the shed.

16. The method of claim 8 wherein said binder strands are crossed at least 5° of the loom cycle before the weft strand groups are crossed to close the shed.

* * * * *